United States Patent [19]

Hornung

[11] Patent Number: 4,481,007

[45] Date of Patent: Nov. 6, 1984

[54] FOLDING MACHINE

[75] Inventor: Adolf Hornung, Reichenberg, Fed. Rep. of Germany

[73] Assignee: Maschinenbau Oppenweiler Binder GmbH & Co., Fed. Rep. of Germany

[21] Appl. No.: 581,206

[22] Filed: Feb. 21, 1984

Related U.S. Application Data

[63] Continuation of Ser. No. 274,255, Jun. 16, 1981, abandoned.

[30] Foreign Application Priority Data

Jun. 16, 1980 [DE] Fed. Rep. of Germany ..... 3022607

[51] Int. Cl.[3] ..... B65H 45/18

[52] U.S. Cl. ..... 493/444

[58] Field of Search ..... 493/442–445

[56] References Cited

U.S. PATENT DOCUMENTS 3,552,737 1/1971 Iltis ..... 493/444 X 4,175,740 11/1979 Klenk ..... 493/444 X

*Primary Examiner*—A. J. Heinz

*Attorney, Agent, or Firm*—John F. A. Earley

[57] ABSTRACT

A folding machine comprises at least one folding unit including a plurality of conveyor belts (12), a stop member (14) extending transversely of the conveyor belts, a plurality of folding rolls disposed below the conveyor belts and extending parallel thereto, a folding blade adapted to be moved within a gap defined by the folding rolls, and a detector device (light barrier 16). The folding machine is characterized by a length-of-path pulse generator (22) coupled to the conveyor belts (12), a presettable counter (24) coupled to the length-of-path pulse generator (22), the start input (26) of said counter being connected to the detector device (16) and the distance between the detector device (16) and the stop member (14) at least equalling the length of the longest sheet to be handled, and a logic circuit (30, 36, 38) adapted to start the folding blade driving means (21) only upon the counter (24) reaching a predetermined count and upon the terminal edge of a sheet having passed the light barrier.

1 Claim, 2 Drawing Figures

FOLDING MACHINE

This application is a continuation of application Ser. No. 274,255, filed June 16, 1981, now abandoned.

BACKGROUND OF THE INVENTION

Field of the Invention

This invention relates to a folding machine comprising at least one folding unit which is provided with a plurality of belt-type conveyors, a stop member extending transversely of the conveyors and a plurality of folding rolls disposed below the conveyors and extending parallel thereto, a folding blade adapted to be moved within a gap defined by the folding rolls and a detector device (light barrier).

BRIEF DESCRIPTION OF THE PRIOR ART

There has been known a folding machine of the type indicated in which the detector in the form of a light barrier is disposed at the stop. The means driving the folding knife are caused to respond after a predetermined time delay after the sheet to be folded has arrived at the stop and in doing so operated the light barrier. This time delay is intended to ensure that the sheet is capable of aligning itself in front of the stop before it is engaged and folded by the folding knife.

In such a known folding machine, should trouble arise in connection with the folding knife or the folding rolls, the means driving the folding knife will continue to be repeatedly operated despite the maloperation so that new sheets are constantly introduced into the folding nip until the operator notices the accumulation of sheets whereupon he can stop the folding machine; alternatively there may be provided a monitoring device designed to respond to an accumulation of sheets. Under such conditions, it is only possible by means of a rugged tool to withdraw the accumulated sheets from the folding machine, this procedure tending to result in serious damage, particularly where an accumulation of sheets occurs at a folding unit disposed downstream of the first unit.

Another disadvantage of said known machine is to be seen in the fact that the time delay between the response of the light barrier and the response of the means driving the folding knife, while being adjustable by hand, is independent of the operating speed of the folding machine, so that, in cases in which too ample a time delay has been selected, a reduction in machine output results, whereas in the case of an insufficient time delay trouble may develop due to the fact that the sheets are not allowed sufficient time for aligning themselves in front of the stop.

OBJECT OF THE INVENTION

It is an object of this invention to provide a folding machine which is adapted to obtain a maximum production rate, to ensure trouble-free operation and to avoid the occurrence of sheet accumulations which would at lest require time-consuming correcting action.

SUMMARY OF THE INVENTION

In the known folding machine described earlier, this object is attained, according to the invention, by the provision of a length-of-path pulse generator coupled to the belt-type conveyors, further by the provision of a presettable counter connected to the length-of-path pulse generator, the start input of the counter being connected to the said detector device, the distance between the detector device and the stop at least equalling the length of the longest sheet to be handled, i.e. the detector is arranged—in the moving direction of the sheet—before the knife, and finally by the provision of a logic circuit which is adapted to start the means driving the folding knife only upon the counter reaching the preset count and after the trailing end of the sheet has passed the light barrier.

In the sheet folding machine of the invention, the counter which is preset for a predetermined length, i.e. the length of the sheet to be folded plus a safety space, is actuated by the leading edge of the sheet being introduced into the folding unit. As soon as the counter has been supplied with a number of pulses corresponding to this preset length, the means driving the folding knife are actuated, provided that the trailing end of the sheet has passed the light barrier. This ensures that the folding knife will only introduce a sheet into the folding nip if a single sheet only is present between the knife and the folding nip.

In view of the fact that, while the accumulation of sheets in the folding nip is avoided, there is a possibility of an accumulation of sheets forming between the folding knife and the folding nip, such an accumulation possibly attaining a considerable thickness, before either the operator or a suitable monitoring device may respond to such a condition, said logic circuit, in a preferred embodiment of the invention, is designed to stop the conveyors, the sheet feeding action and the means driving the folding knife upon the preset count being reached before the trailing edge of a sheet has passed the detector device. In this manner the formation of any major accumulation of sheets between the folding knife and the folding nip is avoided, it being understood that such an accumulation can be removed easily but that an undesirable loss of sheets will result. In the preferred embodiment of the folding machine of the invention, a small number of sheets only are allowed into the folding unit even during high-speed operation of the machine before the supply of sheets is interrupted.

In a folding machine comprising a plurality of folding units in a series arrangement, in order to avoid sheet accumulations in preceding folding units should trouble arise in a downstream folding unit, provisions are made in another preferred embodiment for the folding knife driving means of upstream folding units to be controlled by the logic circuits of downstream folding units.

In a preferred embodiment, the logic circuit comprises the following elements: an RS flip-flop, the reset input of which is adapted to be controlled by the counter-operating edge of the output pulse of the light barrier, whereas its S input is adapted to be controlled by the opposite edge of said pulse, and AND gates, one gate being associated with the folding knife driving means, the other gate being associated with the folding knife and a sheet stopping means, the first input of each such gate being connected to the counter output, the second input being connected to opposed outputs of the RS flip-flops.

The digitalized control system just described may also be embodied in an analog system, this requiring an integrator to be substituted for the counter and a rate controller to be substituted for the length-of-path pulse generator.

BRIEF DESCRIPTION OF THE DRAWINGS

The invention and further particulars will be described more specifically hereinafter with reference to preferred embodiments shown in the drawings, in which.

DETAILED DESCRIPTION OF PREFERRED EMBODIMENTS

Figure 1:
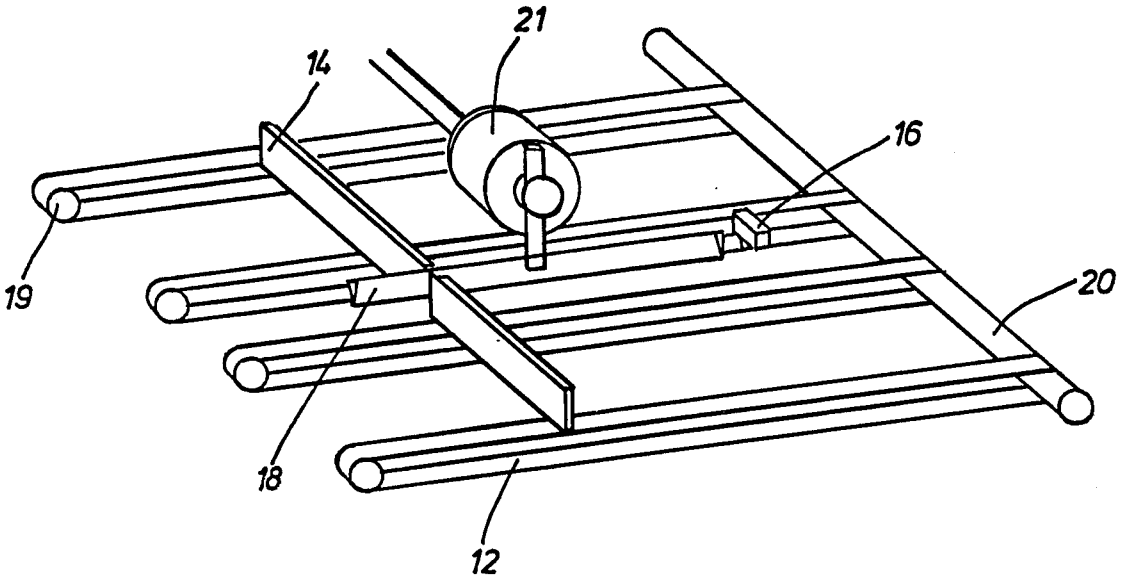
FIG. 1 is a simplified perspective view of a folding unit.
Figure 2:
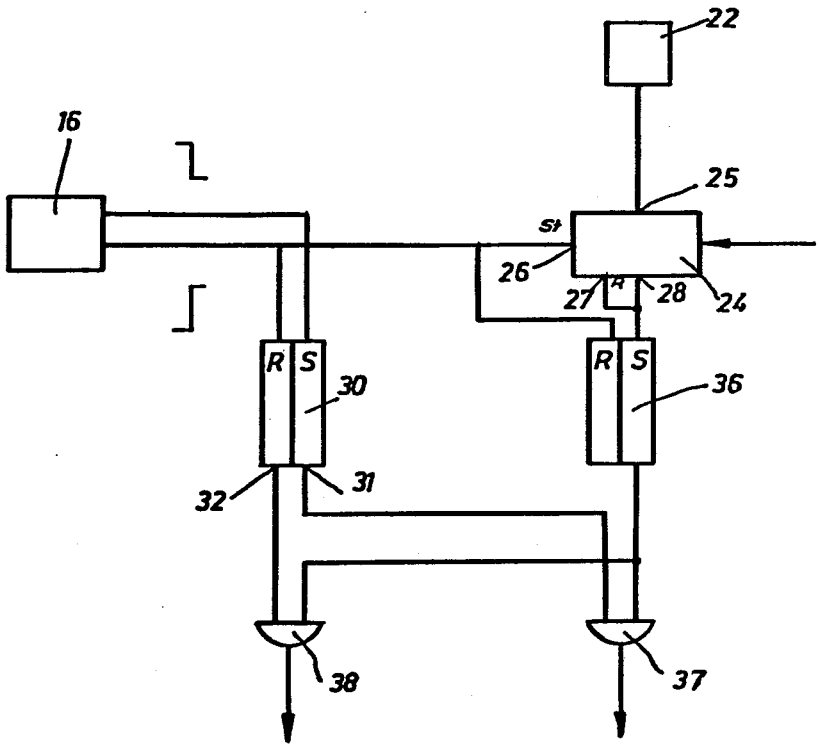
FIG. 2 shows the wiring diagram of the more important elements of the control and logic circuits.

The folding unit shown in FIG. 1 which may have one or more additional folding units arranged upstream and/or downstream thereof comprises conveyor belts 12 which are trained about a driving roll 20 and free-wheeling rolls 19; roll 20 is connected to a length-of-path pulse generator 22 shown in FIG. 2. A stop 14 extends transversely of the conveyor belts 12, the sheets (not shown) being fed against stop 14 from the right side in FIG. 1 to the upper sections of the conveyor belts. Disposed above the upper surfaces of the upper sections of the conveyor belts 12 is a folding knife 18 extending parallel to the conveyor belts, said knife being adapted to be reciprocated upwardly and downwardly by a folding knife driving means 21. Disposed below the upper surfaces of the upper belt sections are folding rolls (not shown), such rolls forming a nip or gap into which the folding knife 18 is adapted to fold the sheets disposed in front of stops 14. A detector device in the form of a light barrier 16 is disposed in the path of the sheets resting on the conveyor belts 12 in front of folding knife 18.

FIG. 2 illustrates the basic structure of a preferred embodiment of a control and logic circuit. Connected to roll 20 (FIG. 1) is a pulse generator 22 adapted to supply a single pulse for each path element traveled, the output of generator 22 being connected to the counting input 25 of a presettable counter 24 of which the starting input is connected to the output of light barrier 16; given a suitable logic arrangement, counter 24 will respond, for example to the rising edge of the output pulse of light barrier 16, which is being produced as the leading edge of a sheet passes the light barrier. Upon reaching the preset count, counter 25 supplies at its output 28 a signal which resets the counter to its starting condition via resetting input 27. The resetting and setting inputs of an RS flip-flop 30 are so connected to light barrier 16 that the resetting input will respond to the rising edge of the output pulse of the light barrier, whereas the setting input of RS flip-flop 30 will be activated by the trailing edge of said output pulse which corresponds to the trailing end of a sheet passing light barrier 16.

The set input of another RS flip-flop 36 is connected to the output 28 of counter 24. This flip-flop will be reset upon the leading edge of the output pulse of light barrier 16 appearing at its reset input.

Arranged downstream of the two RS flip-flops 30 and 31 are AND gates 38, 37, one input of either gate being so connected to the associated RS flip-flops 30 and 36 that a signal L is present at said inputs upon RS flip-flop 36 having been set. The second input of AND gate 37 is connected to the direct output 31 of RS flip-flop 30, whereas the second input of the second AND gate 38 is connected to the opposite output 32 of RS flip-flop 30 so that opposed signal levels will appear at the second inputs of AND gates 37 and 38. The folding machine of the invention operates in the manner described below:

First of all, the presettable counter 24 is set for the length of the sheets to be handled via the input indicated by an arrow in FIG. 2. As soon as the leading edge of a sheet entering the folding unit passes light barrier 16, the light barrier provides a pulse of which the leading edge, for example, starts counter 24 and resets flip-flops 30 and 36. Upon the preset count being reached by counter 24, there will appear at the counter output 28 a signal by which RS flip-flop 36 is set. As soon as the trailing edge of the output pulse of light barrier 16 has set RS flip-flop 30, AND gate 37 will activate the folding blade driving means 21 which has been awaiting its operating command in the upper dead center position of blade 18. As soon as blade 18 has introduced the sheet into the folding gap and has returned to its upper dead center position, the brake of the folding blade drive means will be operated so as to stop the blade again in its upper dead center position. The circuit controlling the folding blade drive means and its brake is constructed in such a manner that, after completion of one stroke of blade 18, the brake operating means is ready to perform another operating cycle.

The AND gate 37 will only be operated after RS flip-flop 30 has been set by the trailing edge of the output pulse of light barrier 16. As long as no trailing edge of a pulse occurs, AND gate 37 will remain inhibited, and the folding blade driving means 21 cannot be operated. While RS flip-flop 30 is still in its reset state, AND gate 38 responds simultaneously in order to stop the folding machine, the folding blade and the sheet supply, whereupon no further sheets are allowed to enter the folding unit.

What is claimed is:

1. A high-speed paper folding machine comprising a folding station, conveyor means (12, 20, 19) for conveying a series of paper sheets having a leading edge and a trailing edge to the folding station at high speed, stop means (14) for stopping and transversely aligning transversely a leading edge, knife means (18) for folding each sheet in the folding station, folding knife driving means (21) for driving folding knife means (18) to fold each paper sheet, detector means (16) positioned upstream of stop means (14) by at least the length of the longest sheet of paper to be handled for detecting the leading edge of each sheet, timing means (22,24) connected to the detecting means (16) for actuating the knife driving means (21) to drive the folding knife means (18) to fold each paper sheet, said detector means (16) including detector means (16) for sensing the trailing edge of the sheet and means (30, 36, 38) for preventing actuation of the knife means (18) until the trailing edge has passed the detector means (16), said detector means (16) including means for sensing the trailing edge of the sheet and means (30, 36, 38) for stopping the conveyor means (12, 20, 19) and the feeding of sheets to the folding station until the trailing edge has passed the detector means (16).

* * * * *